US005911640A

United States Patent [19]

Breitwieser et al.

[11] Patent Number: 5,911,640

[45] Date of Patent: Jun. 15, 1999

[54] HUNTING ARROWHEAD WITH IMPROVED FLIGHT CHARACTERISTICS AND CUTTING CAPABILITIES

[76] Inventors: Robert Dwane Breitwieser, 4757 S. Lantana Cir., Tucson, Ariz. 85730; Richard Curtis Jamison, 5821 S. Helena Strav., Tucson, Ariz. 85706

[21] Appl. No.: 08/522,855

[22] Filed: Sep. 1, 1995

Related U.S. Application Data

[63] Continuation of application No. 08/285,482, Aug. 3, 1994, abandoned.

[51] Int. Cl.[6] ..... F41B 5/02

[52] U.S. Cl. ..... 473/584

[58] Field of Search ..... 473/582, 583, 473/584

[56] References Cited

U.S. PATENT DOCUMENTS

| | | | |
|---|---|---|---|
| 2,212,345 | 8/1940 | Krieger | 273/421 X |
| 3,578,328 | 5/1971 | Rickey . | |
| 3,618,948 | 11/1971 | McGlocklin | 273/421 |
| 3,910,579 | 10/1975 | Sprandel . | |
| 3,915,455 | 10/1975 | Savora . | |
| 4,111,424 | 9/1978 | Schreiber et al. . | |
| 4,254,958 | 3/1981 | Bateman, III | 273/421 |
| 4,268,038 | 5/1981 | Wierenga . | |
| 4,565,377 | 1/1986 | Troncoso, Jr. et al. | 273/422 |
| 4,940,246 | 7/1990 | Stagg . | |
| 5,046,744 | 9/1991 | Eddy . | |
| 5,078,407 | 1/1992 | Carlston et al. . | |
| 5,090,709 | 2/1992 | Johnson . | |
| 5,257,809 | 11/1993 | Carrizosa | 273/422 |

OTHER PUBLICATIONS

Gander Mountain Archery '93 catalog; Apr. 1993; P.25; Stopper Point.

*Primary Examiner*—Mark S. Graham

[57] ABSTRACT

An improved hunting tip in which helical blades extend around the inner core of the head and causes the arrow to rotate during flight. The rotation creates a stabilizing motion, and when the arrow enters its prey, the outer edges of the helical blades, being sharpened, create an "auguring" effect causing increased bleeding in the prey and having a more lethal effect. The lethal effect caused by the hunting tip is further increased by the fact that the helical blades extend forward and around the center sharpened tip of the hunting tip, thereby increasing the initial cutting diameter of the arrow. The helical blades are rotatably attached to the hunting tip, thereby providing for removability of the blades. This simplifies repair and, therefore, increases the useful life of the hunting tip.

16 Claims, 2 Drawing Sheets

HUNTING ARROWHEAD WITH IMPROVED FLIGHT CHARACTERISTICS AND CUTTING CAPABILITIES

This is a continuation of application, Ser. No. 08/285,482 filed on Aug. 3, 1994 and entitled "IMPROVED HUNTING ARROWHEAD WITH IMPROVED FLIGHT CHARACTERISTICS AND CUTTING CAPABILITIES", now abandoned.

BACKGROUND OF THE INVENTION

This invention relates generally to archery equipment and more particularly to hunting tips for arrows.

The bow and arrow has been around since the stone-age and is reflective of how Man's tool making ability has, and will, give him a survival edge. In modern times, the bow is no longer viewed as a necessary component for survival but has taken on more of a recreational stand. Like its predecessors, the modern arrow is used to kill prey by causing bleeding and hemorrhage within the animal. The basic axiom is that the more bleeding the arrow causes, the more lethal the arrow.

To this end, a wide variety of arrowheads have been developed which seek to increase the cutting aspect of the arrowhead. These include: U.S. Pat. No. 5,078,407, entitled "Expandable Blade, Composite Plastic, Broadhead Hunting Arrow Tip" issued to Carlston et al. on Jan. 7, 1992; U.S. Pat. No. 5,090,709, entitled "Arrowhead with Extendable Blades" issued to Johnson on Feb. 25, 1992; U.S. Pat. No. 4,940,246, entitled "Arrow Attachment" issued to Stagg on Jul. 10, 1990; U.S. Pat. No. 5,046,744, entitled "Hunting Point for Arrows" issued to Eddy on Sep. 10, 1991; U.S. Pat. No. 3,915,455, entitled "Removable Very Sharp Quality Cutting Blades Extending From Very Near by the Tip to the Arrow Shaft" issued to Savora; U.S. Pat. No. 3,578,328, entitled "Arrowhead with Pivoted Blades" issued to Rickey on May 11, 1971; U.S. Pat. No. 4,268,038, entitled "Accessory for an Arrow " issued to Wierenga on May 19, 1981; U.S. Pat. No. 3,910,579, entitled "Swivel-Mounted Hunting Arrowhead "issued to Sprandel on Oct. 7, 1975; and, U.S. Pat. No. 4,111,424, entitled "Arrow and Arrow Attachments" issued to Schrieiber et al., on Sep. 5, 1978.

In all of these situations, the devices attempt to create more cutting edges to contact the flesh of the targeted animal. While this does increase the effective kill potential for arrows that strike their target, the designs of these devices create new air-foils causing some arrows to veer off or to catch slight breezes forcing the arrow off its "mark"; missing the animal altogether.

It is clear from the foregoing that there is a need for an aerodynamic arrow head that flies true but which can cause the maximum cutting at impact.

SUMMARY OF THE INVENTION:

The invention is an improved hunting tip for an arrow in which helical blades extend around the inner core and cause the arrow to rotate during flight. This rotation creates a stabilizing motion, and when the arrow enters its prey, the outer edges of the helical blades, being sharpened, create an "auguring" effect causing increased bleeding in the prey, a more lethal affect.

The hunting head consists of substantially two pieces, an inner core and the helical blades. The inner core is an aerodynamic piece in which a leading tip is sharpened. The other end of the inner core, or shaft, is structured to be mounted onto an arrow's shaft. This type of mounting is accomplished through adhesives or, as in the preferred embodiment, a screw mechanism which screws into an end of the arrow shaft.

Two or more helical blades are attached to the inner shaft and extend around a portion of the leading tip of the shaft so as to mimic the inner shaft's contours. In the preferred embodiment, four helical blades are used, but those of ordinary skill in the art readily recognize that two or more such helical blades are applicable to this mechanism.

During flight, the helical shape of these blades causes the arrow to rotate. This rotation creates an extremely stable flight path for the arrow, thereby all but eliminating wobble.

Preferably, the helical blades are constructed of a mild steel material permitting the blades to be resilient instead of brittle. The mild steel construction permits the arrowhead to be repeatedly bent, adjusted, and reused before metal fatigue develops, forcing the arrow head to be discarded.

In the preferred embodiment, the helical blades are rotatably mounted to the shaft member of the arrowhead and are secured by attachment of the arrow's shaft which compresses the swivel mounting between the arrow shaft and the inner shaft member of the arrow head.

Also, in the preferred embodiment, the helical blades and their interconnections are created from a single substantially circular piece of metal which has its entire circumference sharpened. By bending the blade portions from this circular piece, the entire helical blade mechanism is created in a single stamping operation.

Prior to stamping, the exterior surfaces of the helical blades are sharpened so that as the arrowhead enters the prey's body, the helical blades, which had been used for the creation of rotation, now act as an auguring action to slice a significant amount of flesh so as to increase the bleeding of the prey. This increased bleeding makes the present invention's arrow head even more lethal.

The invention, together with various embodiments thereof, will be more fully explained by the accompanying drawings and the following description.

DRAWINGS IN BRIEF

Figure 3A:
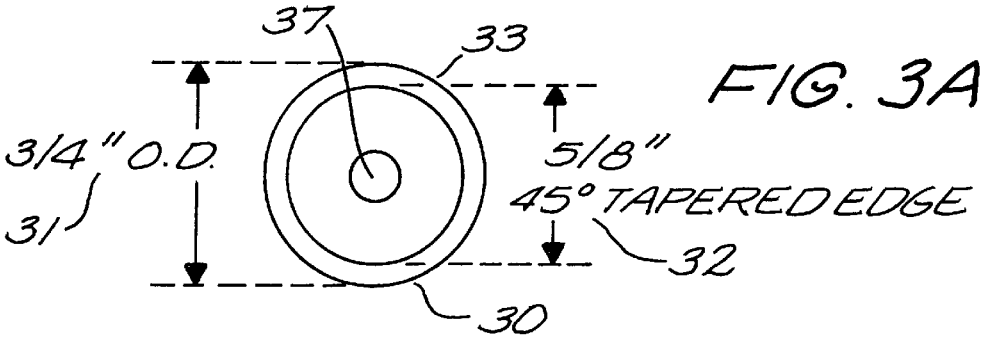
Figure 3B:
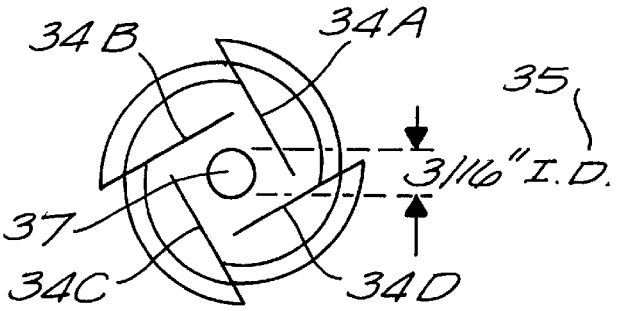
Figure 3C:
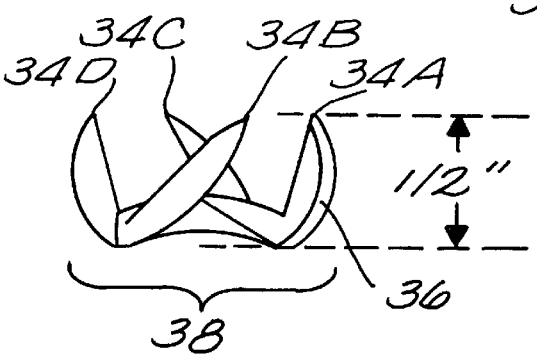

FIGS. 3A, 3B, and 3C illustrate the preferred manufacturing steps in creating the preferred helical blades from a single piece of mild steel stock.

Figure 4:
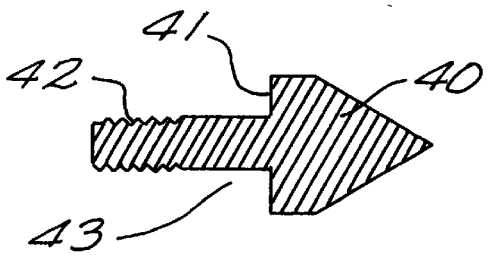

FIG. 4 is a side view of the preferred inner shaft member for the hunting head of this invention.

Figure 5:
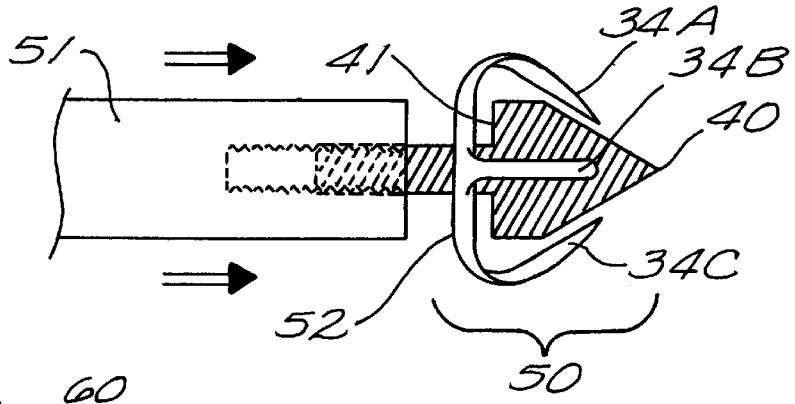

FIG. 5 is a side view illustrating the mounting and securement of the arrowhead, helical blades, and the arrow shaft.

Figure 6:
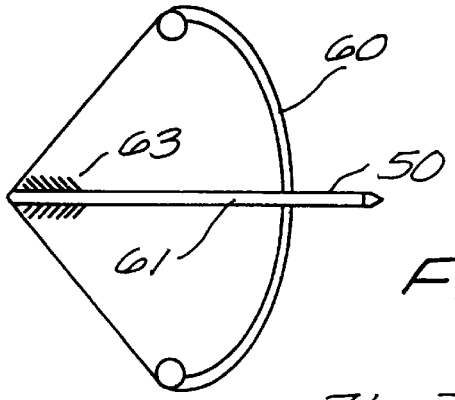

FIG. 6 illustrates the present invention mounted onto an arrow shaft on an archery bow.

Figure 7A:
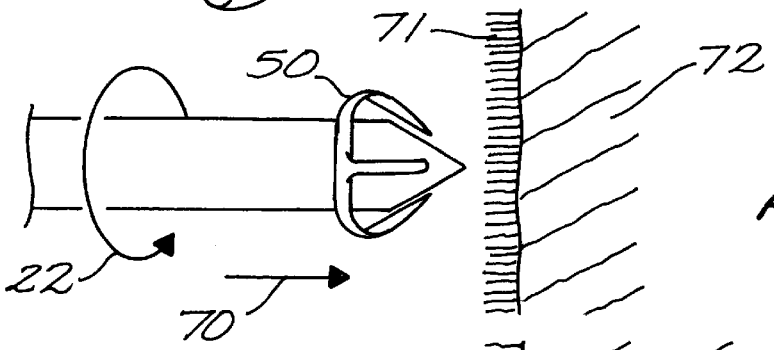
Figure 7B:
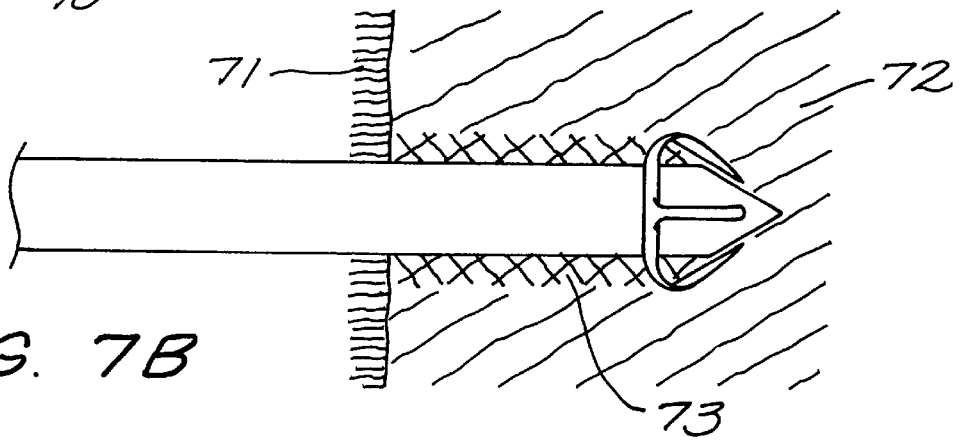

FIGS. 7A and 7B illustrate the helical blade's cutting potential as the arrow head enters a prey.

DRAWING IN DETAIL

Figure 1:
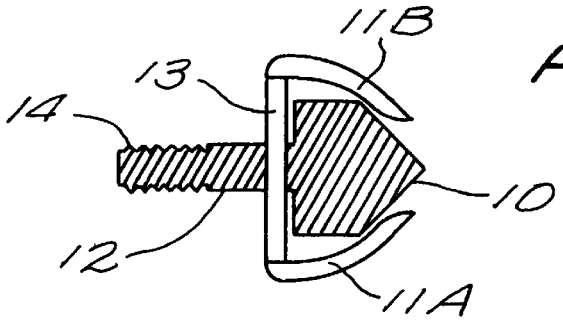
FIG. 1 is a side view of an embodiment of the invention using two helical blades.

FIG. 1 is a side view of an embodiment of the invention using two helical blades.

Arrowhead 13 is composed of an inner shaft member 10 and flight blades 11A and 11B. Two blades 11A and 11B are used in this embodiment although any number greater than 2 is possible so long as they are arranged equidistant from each other as they encircle the inner shaft member 10. This equidistant requirement assists in assuring a stable flight of the arrow.

The flight blades 11A and 11B serve two functions: rotate the arrow shaft (not shown) during flight, and create additional cutting surfaces to make the arrow head more lethal. Rotation is created by constructing the flight blades 11A and 11B in helical fashion. Flight blades 11A and 11B are arranged to mimic the pointed contour of the inner shaft 10. More cutting surface is accomplished by sharpening selected edges of flight blades 11A and 11B.

Threaded end 14 is used to secure the arrowhead 13 to the arrow shaft (not shown). The rotation of the arrowhead in flight is such that the threads are tightened during flight so as to prevent arrowhead 13 from being loosen during flight and lost.

Note, in this embodiment, the point of the inner member extends well past the most forward portion of flight blades 11A and 11B. This arrangement uses the point to form the first incision in the prey, thereby facilitating the entry of the flight blades and their cutting edges.

Figure 2:
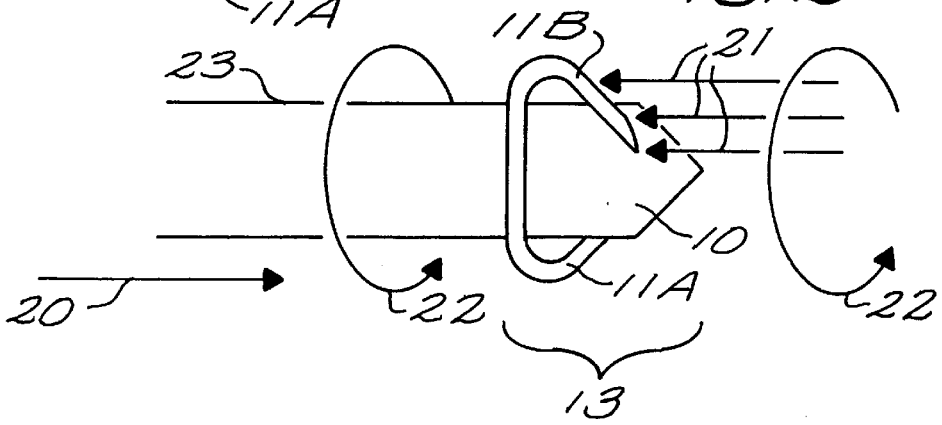
FIG. 2 illustrates the wind dynamics which are capitalized upon using the present invention for the rotation of the arrow in flight.

FIG. 2 illustrates the wind dynamics which are capitalized upon using the present invention for the rotation of the arrow in flight.

Arrow shaft 23 is connected to arrow head 13 through the screw mechanism 14 of FIG. 1. During flight, in the direction indicated by 20, wind forces 21 impinge upon flight blades 11A and 11B causing a rotational movement 22 in the arrow. This rotation 22 has the same effect as the spiraling of a bullet, it levels the arrow's flight, reduces wobble, and creates a more accurate flight path.

The overall width of the flight blades are chosen to comply with various state and federal laws. Since, in the preferred embodiment, the outside edges of the flight blades 11A and 11B are sharpened, this establishes the cutting width. In most states, a cutting width of seven-eighths of an inch is required; hence, the maximum distance from blade 11A to blade 11B must be greater than seven-eighths of an inch to comply with these laws. Through selective modification of the flight blades 11A and 11B, any size requirement is obtainable.

FIGS. 3A, 3B, and 3C illustrate the preferred manufacturing steps in creating the preferred helical blades from a single piece of stock.

Referring to FIG. 3A, using a generally round and flat stock plate, a center hole 37 is created having sufficient diameter to fit over the inner member's central portion. The outer edge of the flat stock plate is sharpened through beveling at a forty-five degree angle; hence, starting with a seven-eighths inch stock, the bevel is made having an inside diameter such that forty-five degrees is obtained. Other angles for the bevel and overall dimensions are obvious to those of ordinary skill in the art.

As shown in FIG. 3B, four cuts are made angling into the stock (34A, 34B, 34C, and 34D) to create the four cutting blades of the present invention. Note that these cuts create a generally square member encircling the center hole 37.

The segments created by 34A, 34B, 34C, and 34D, are then forced upward to extend generally perpendicular to the base plate 38 having the center hole, FIG. 3C (now a side view). By angling the cutting blades 34A, 34B, 34C, and 34D, the desired helical affect is obtained.

In this embodiment, helical blades 34A, 34B, 34C, and 34D, stand approximately a half-inch above the base plate 38.

As noted earlier, the material used in the creation of the flight blade is a mild steel stock which easily permits this bending of the original round stock. The mild steel stock used permits in-field adjustment of the blades as well. Should a blade be mangled during a shot, the archer need only manually re-align the helical blades using a pair of pliers.

The helical blades 34A 34B, 34C, and 34D, are manipulated so that they mimic a portion of the inner member. This mimicking increases stability during flight and overall cutting potential for the arrowhead.

FIG. 4 is a side view of the preferred inner shaft member for the hunting head of this invention.

Inner member 43 is a solid stock having one end sharpened to a point 40 while the other end has attachment means 42, a screw attachment mechanism in this embodiment. Shoulder 41 is used to press against the base plate of the arrowhead (not shown).

FIG. 5 is a side view illustrating the mounting and securement of the arrow head, helical blades, and the arrow shaft of the preferred embodiment.

In securing the arrowhead 50 against the arrow shaft 51, the base plate 52 of the flight blades is pressed therebetween and forced into shoulder 41. This pressure securement has been found to be sufficient for the task at hand. Other methods include using a key to maintain the flight blades in constant, and fixed, relationship with inner member 40.

FIG. 6 illustrates the present invention mounted onto an arrow shaft on an archery bow.

Arrow head 50 is affixed onto one end of an arrow shaft 61 having fletchings located at the other end. Once strung onto a archery bow 60, the improved hunting arrow 61 is more lethal than the current art.

FIGS. 7A and 7B illustrate the helical blade's cutting potential as the arrowhead enters a prey.

As shown in FIG. 7A, the improved hunting arrow is shot toward the prey 71 as shown by arrow 70. During flight, the arrow shaft rotates as indicated by arrow 22. The purpose 's of the hunting arrow is to force the arrowhead into the prey causing the maximum amount of bleeding.

As the hunting arrow penetrates the prey, FIG. 7B, the helical shaped cutting blades work in an "gauger" fashion to cut the flesh 72 of prey 71 as 31 shown by sliced portions 73. The more such slicing is done, the more bleeding that will occur making the killing of the prey quicker and more humane.

It is clear that the present invention creates a new and improved hunting head that both: creates a more accurate flight for the arrow; and also significantly increases the cutting/slicing of the prey for a more lethal arrow.

What is claimed is:

1. An improved archery hunting head comprising:

a) an inner shaft member having a sharpened first end with a tapered surface, and a threaded second end; and, b) a flight blade being affixed to a center portion of said inner shaft member, said flight blade having at least two forward extending sharpened helical blades spaced from and positioned proximate to said sharpened first end of said inner shaft such that a forward portion of each of said forward facing sharpened helical blade extends substantially to said sharpened first end of said inner shaft wherein the blades are contoured to follow the contours of the tapered surface.

2. The improved archery hunting head according to claim 1 wherein said flight blade is swivelly attached to said inner shaft such that an arrow shaft presses and secures said flight blade to said inner shaft during attachment of said archery hunting head to said arrow shaft.

3. The improved archery hunting head according to claim 2 wherein said helical blades are shaped to rotate said arrow shaft during flight.

4. The improved archery hunting head according to claim 2 wherein said at least two helical blades are four helical blades positioned equal distance around said inner shaft.

5. The improved archery hunting head according to claim 4 wherein said sharpened first end of said inner shaft extends past a leading tip of each of said helical blades.

6. A hunting head for an arrow comprising:

a) a generally cylindrical main body having a tapered first end and an attachment means for securing said cylindrical main body to an arrow at a second end thereof; and, b) a cutting member being composed of mild steel and having, 1) a substantially square base plate having a center hole encircling said cylindrical main body, and, 2) four helical blades, each of said blades spaced from and positioned proximate to said tapered first end such that a forward portion of each of said blades extend substantially to the tapered first end and wherein the blades are contoured to follow the contours of the tapered surface.

7. The hunting head according to claim 6 wherein said substantially square base plate and said four blades are constructed from a single generally circular flat member.

8. The hunting head according to claim 7 wherein an outer circumference of said single generally circular flat member is sharpened.

9. The hunting head according to claim 6 wherein said cutting member is swivelly attached to an inner shaft that an arrow shaft presses and secures said flight blade to said inner shaft.

10. The hunting head according to claim 9 wherein selected edges of said cutting member are sharpened.

11. The hunting head according to claim 10 wherein said four blades are shaped in a helical manner so as to rotate said arrow shaft during flight.

12. A hunting assembly comprising:

a) an archery bow; and, b) an arrow to be shot from said bow, said arrow having, 1) a shaft member, 2) fletching located at one end of said shaft member, and, 3) a hunting head having, A) an inner shaft having a sharpened first end with a tapered surface, and a threaded second end being attached to said shaft member, and, B) a flight blade being affixed to a center portion of said inner shaft said flight blade having at least two forward extending sharpened helical blades spaced from and positioned proximate to said sharpened first end of said inner shaft such that a forward portion of each of said forward facing sharpened helical blades extends substantially to said sharpened first end of said inner shaft wherein the blades are contoured to follow the contours of the tapered surface.

13. The hunting assembly according to claim 12 wherein said flight blade is swivelly attached to said inner shaft such that an arrow shaft presses and secures said flight blade to said inner shaft during connection of said hunting head with said shaft member.

14. The hunting assembly according to claim 13 wherein selected edges of said flight blade are sharpened.

15. The hunting assembly according to claim 12 wherein said at least two helical blades are four helical blades positioned equal distance around said inner shaft.

16. The hunting assembly according to claim 15 wherein said sharpened first end of said inner shaft extends slightly past a leading tip of each of said helical blades.

* * * * *